United States Patent [19]

Kelly

[11] 4,050,401

[45] Sept. 27, 1977

[54] BARRICADE SYSTEM

[75] Inventor: Henry W. Kelly, Cottage Grove, Oreg.

[73] Assignee: Wanda McCullough, Felton, Calif. ; a part interest

[21] Appl. No.: 643,130

[22] Filed: Dec. 22, 1975

[51] Int. Cl.[2] ..... E01F 9/01; E01F 9/10

[52] U.S. Cl. ..... 116/63 P; 404/6

[58] Field of Search ..... 116/63 P, 63 R; 256/13.1, 65, 62, 71; 404/6

[56] References Cited

U.S. PATENT DOCUMENTS

| | | | |
|---|---|---|---|
| 3,119,588 | 1/1964 | Keats | 116/63 P |
| 3,380,428 | 4/1968 | Abrams | 116/63 P |
| 3,380,429 | 4/1968 | Moinicken | 116/63 P |

*Primary Examiner*—S. Clement Swisher
*Assistant Examiner*—Denis E. Corr
*Attorney, Agent, or Firm*—Clarence A. O'Brien; Harvey B. Jacobson

[57] ABSTRACT

A barricade system for erection in a jiffy comprises various interchangeable components for quickly and easily making up a barricade appropriate to the immediate situation.

21 Claims, 35 Drawing Figures

BARRICADE SYSTEM

BACKGROUND OF THE INVENTION

1. Field of the Invention

This invention relates to a system for erecting barricades in a jiffy as appropriate to the on-site situation. A number of different components are employed in this system.

2. Description of the Prior Art

There are many different types of barricade devices, and traffic warning devices known in the prior art. None of these known prior art devices, however, offers the versatility, flexibility, and ability to quickly adapt the component parts into an appropriate barricade for the situation. Some known prior art barricades are taught in the patents to Fairbairn, U.S. Pat. No. 1,457,900; Adams, U.S. Pat. No. 1,794,434; Stringer, U.S. Pat. No. 2,392,011; and Simpson, U.S. Pat. No. 3,057,601. The U.S. Pat. to Tingley, No. 1,275,795 shows somewhat related structure as adapted to fencing. And the U.S. Pats. to Underwood, No. 2,583,244 and Moinicken et al, No. 3,380,429 teach traffic warning signal lights which may be pertinent to this invention. None of these patented devices has the features of the component system disclosed by this invention.

SUMMARY OF THE INVENTION

An object of the present invention is to provide a barricade system which is erectable in a jiffy.

Another object of the present invention is to provide various component parts for a barricade system which are flexible and adaptable in their use.

Another object of this invention is to provide barricade structures which include warning light/reflector devices.

There has always been a problem with barricades as taught in the prior art in being able to adapt same for different on-site situations, and/or problems which differ from the most common type problems. With the system and components therefor disclosed by this invention the drawbacks of prior art devices are eliminated. The system of this invention allows for flexible adaptation to any given on-site problem. Warning signs and signals, etc. are readily arranged with the components of this system to adequately warn a passing motorist or pedestrian of eminent danger. This is extremely important in today's high speed motor vehicle traffic. And also with the tremendous increase in pedestrian, bicycle, and motorcycle type traffic.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
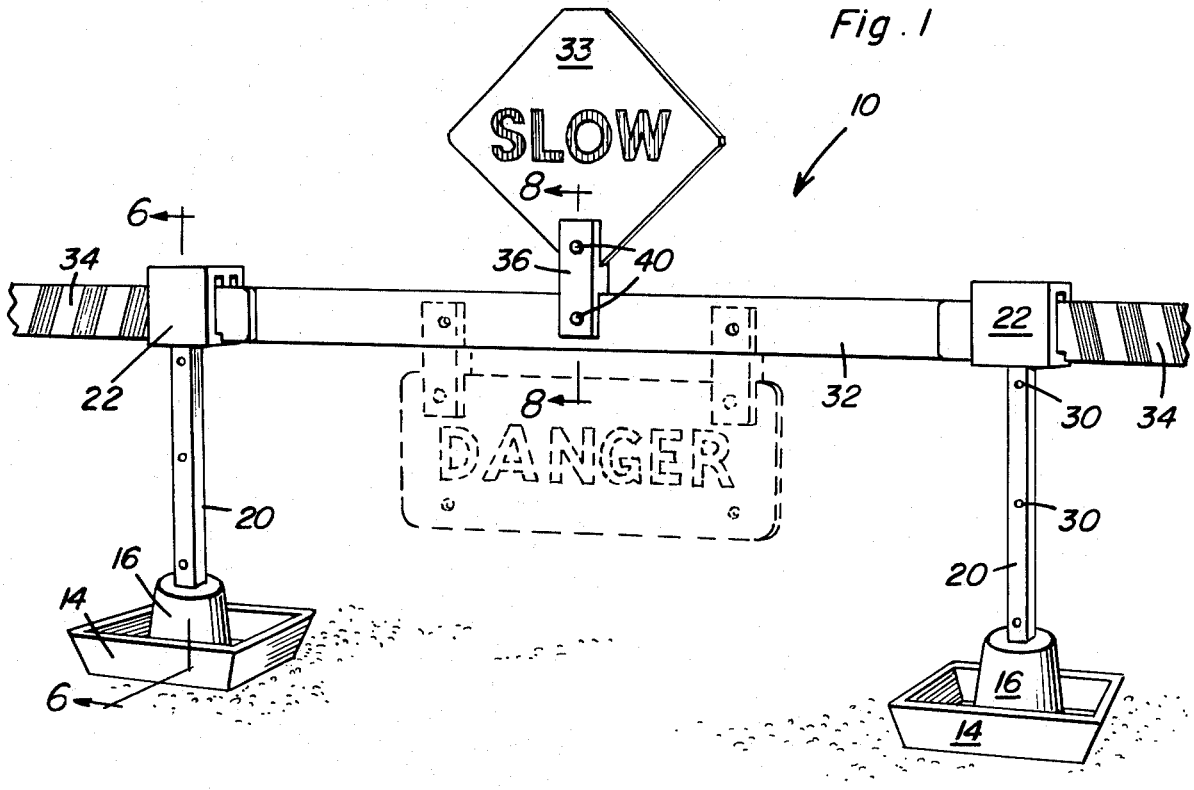
FIG. 1 is a perspective view of components of the barricade system erected on-site.
Figure 2:
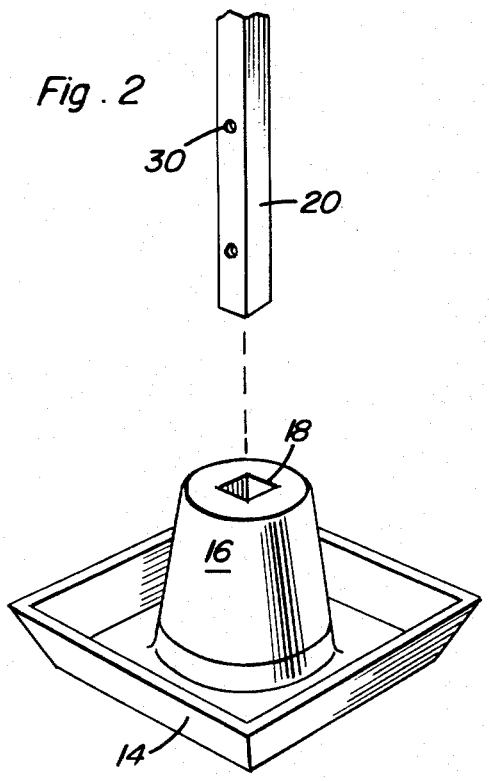
FIG. 2 is a perspective view of a typical support post and base unit.
Figure 14:
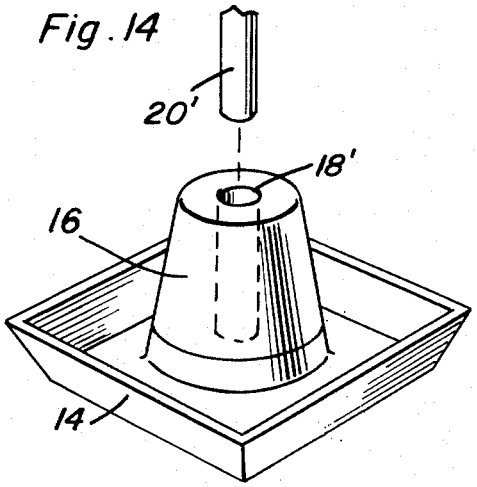
FIG. 14 is a perspective view of another embodiment of the base unit and support structure.

Referring now to the drawings one embodiment of the barricade system is shown by reference numeral 10 in FIG. 1. Reference numeral 12 indicates another barricade warning structure in FIG. 9. In both these figures reference numeral 14 refers to a base pan unit having a supporting cone structure 16 mounted thereon. FIGS. 2 and 14 show the base unit with cone structure in perspective view. The cone of FIG. 2 has a square socket 18 for receiving a square support post 20. FIG. 14 shows a round socket 18' for receiving a round support post 20'. In all of the modifications disclosed either square or round sockets and posts may be utilized, however, in most instances the square type is to be preferred. The reason being that the square type offers more rigidity and resistance to twisting under windy load conditions.

Figure 3:
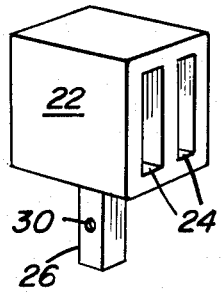
FIG. 3 is a perspective view of one type of head unit.
Figure 4:
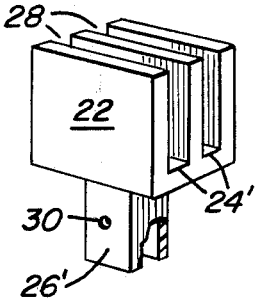
FIG. 4 is a perspective view of another type of head unit.

FIG. 3 shows a head unit having double slotted portions 24 therein. The stem post for allowing assembly of the head unit with other components of the barricade system is shown by reference numeral 26. FIG. 4 shows a modified embodiment of a head unit wherein the slotted portions 24' are open at the top as indicated by reference numeral 28. The stem post 26' is also of different construction in that it has a center hollow portion of square or round shape for receiving a support post 20 which is different from the stem post 26 of FIG. 3 which must be used with an adapter unit.

Figure 5:
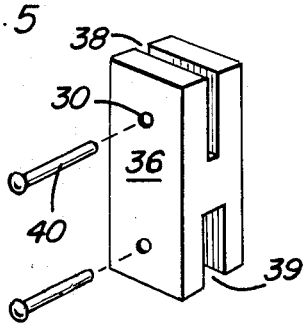
FIG. 5 is a perspective view of a universal adapter.

FIG. 5 shows a universal adapter for attaching warning signs to a cross tie device. Reference numeral 32 as shown in FIG. 1, refers to such a cross tie, as does reference numeral 34 indicating a cross tie having warning indicia thereon. The universal adapter of FIG. 5 labeled 36 has slots 38 and 39 therein of different widths. This adapter is used as shown in FIG. 1 to mount warning signs on or from cross tie members 32, 34. Such signs as indicated by the SLOW sign in FIG. 1 and the DANGER sign in the same figure are held in place by means of pins 40. Pins 40 are preferably made of plastic or rubber composition. Being made of such a composition they will be frictionally retained in the respective holes 30 of the various support and barricade device members to firmly lock such members together.

Figure 6:
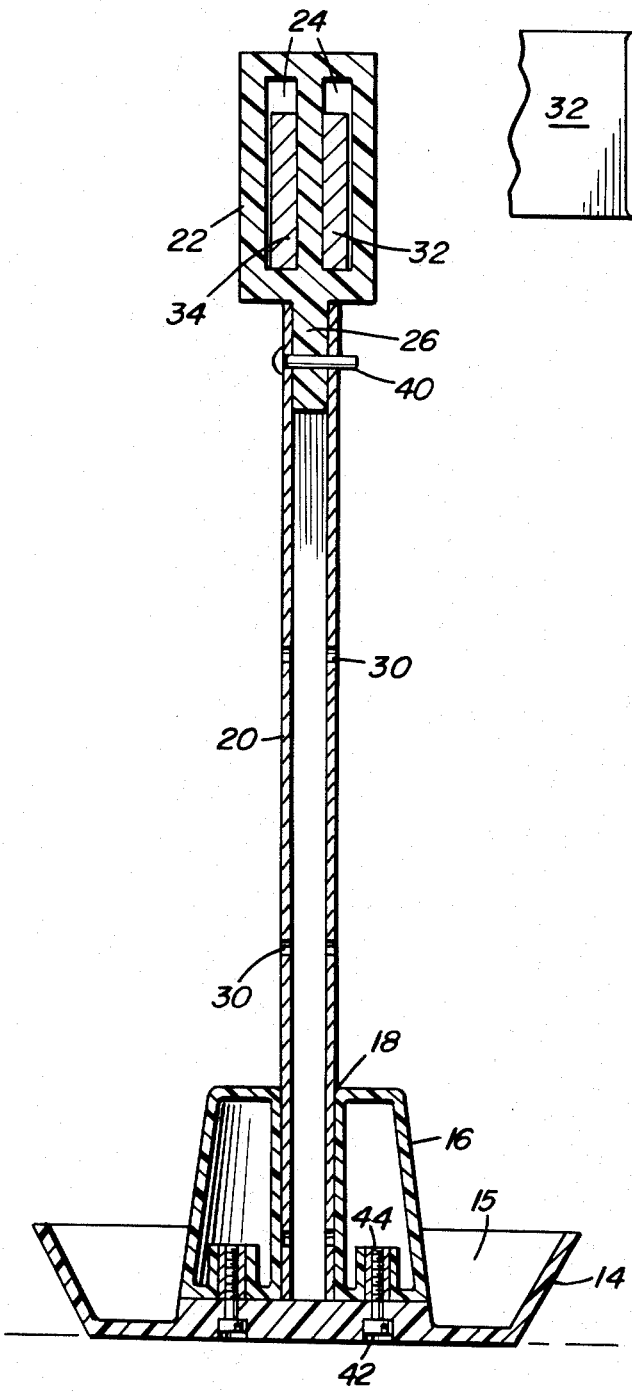
FIG. 6 is a vertical sectional view taken generally along the line 6—6 of FIG. 1.
Figure 7:
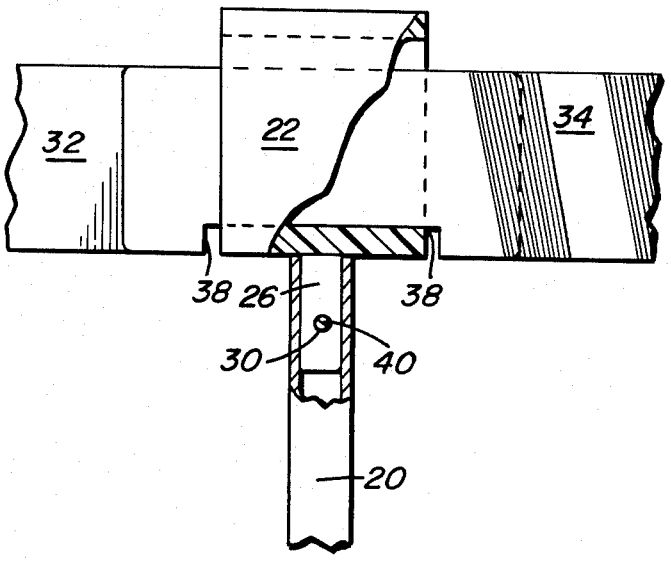
FIG. 7 is a sectional view of the head unit and cross ties of FIG. 1.

FIG. 6 shows a cross-sectional view of the barricade system of FIG. 1. As can be seen in this view the closed type support head 22 with slots 24 therein is mounted on the top of support post 20 by means of support pin member 26 and retained as assembled by means of pin 40 through the aligned holes 30 in the respective members. As can be seen in this view and also the view of FIG. 7, the respective ends of the cross tie members 32 and 34 are supported within the head. Each end of the respective cross tie members has a recess portion 38 therein for the purpose of locking the ends in the support head member. The normal weight of the cross tie members will be sufficient to keep the members locked in the support head due to the recess.

Figure 8:
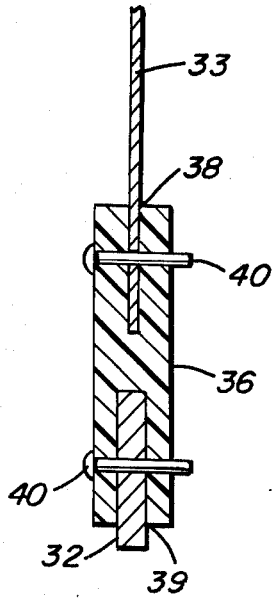
FIG. 8 is a vertical sectional view taken generally along line 8—8 of FIG. 1.

FIG. 6 also shows one method of retaining the base pan unit 14 and the support cone unit 16 removably locked together. In this figure screw threads 44 are provided on the cone 16 for engagement with screws 42 coming up through the base pan unit 14. This type of connecting structure is reliable and yet quite convenient. Again it is noted that the support post 20 and the cone support socket 18 may be of either square or round configuration. FIG. 8 is a cross-sectional view of the universal adapter of FIG. 5 and is shown as in FIG. 1 being mounted on a cross tie 32 for supporting a warning sign 33 with pins 40 holding the units together.

Figure 9:
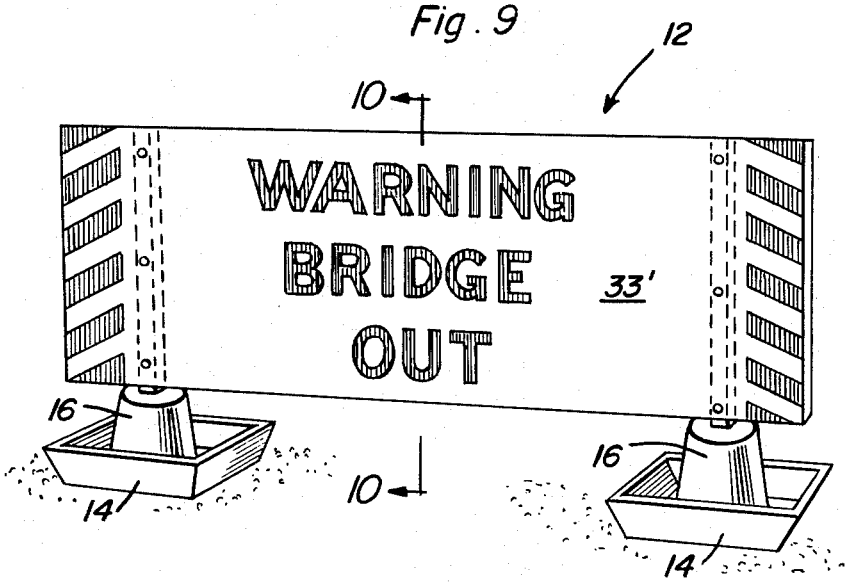
FIG. 9 is another perspective view of a slightly different form of barricade system.
Figure 10:
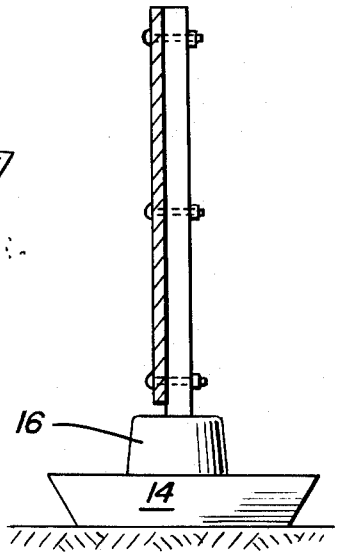
FIG. 10 is a vertical sectional view taken generally along line 10—10 of FIG. 9.
Figure 11:
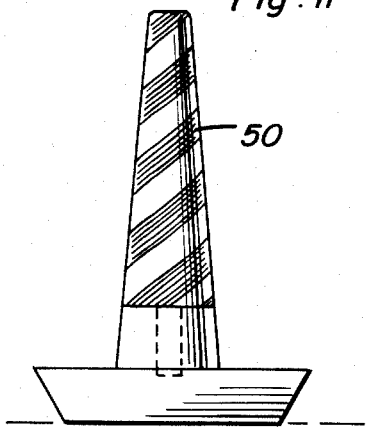
FIG. 11 is a side elevational view of a base unit having a cone type warning structure thereon.
Figure 12:
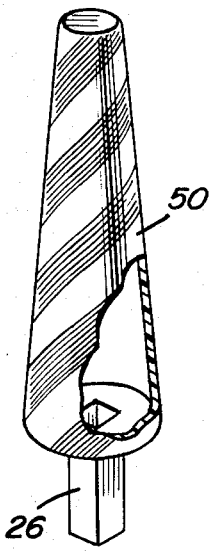
FIG. 12 is a partly sectional perspective view of the cone structure of FIG. 11.
Figure 13:
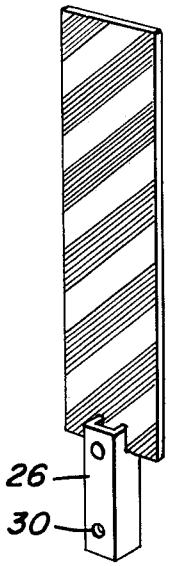
FIG. 13 is a perspective view of another type warning structure according to this invention.

The components of this disclosed barricade system, i.e. the base pans, the cone units, and the support posts may be utilized as shown in FIG. 9 to support large warning signs. FIG. 10 shows in a side elevational view how such large signs may be directly bolted to the support posts. The base units and cone member attachable thereto to form the complete base assembly are also usable to support other type warning devices such as shown in FIGS. 11, 12 and 13. The warning devices of FIGS. 11 and 12 are cone shaped barber pole type warning devices, while the one in FIG. 13 is a rectangular flat shaped barber pole marked warning device. All three of these figures show the square support post, however round posts may be used equally as well. But with a type as shown in FIG. 13 being flat, the square type support offers the obvious advantage of not permitting rotation of the sign.

Figure 15:
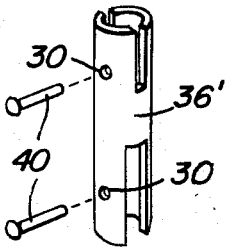
FIG. 15 is a perspective view of another form of universal adapter.

FIG. 15 shows a round type universal adapter similar to the universal adapter of FIG. 5 and FIG. 8 and having holes 30 therein for receiving assembly pins 40.

Figure 16:
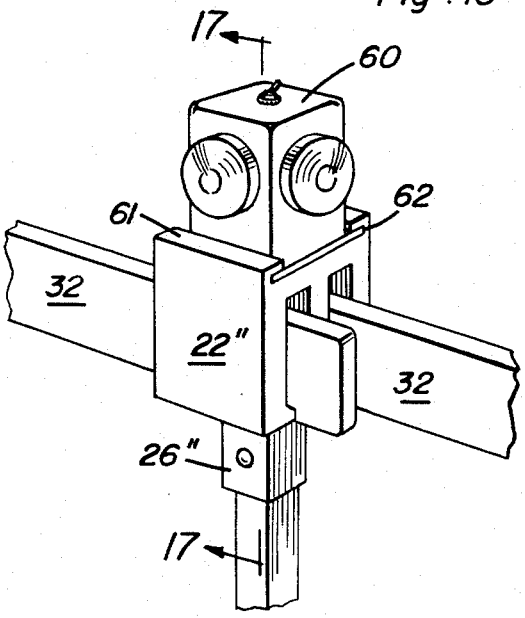
FIG. 16 is a perspective view of another form of head unit for supporting a warning light.
Figure 17:
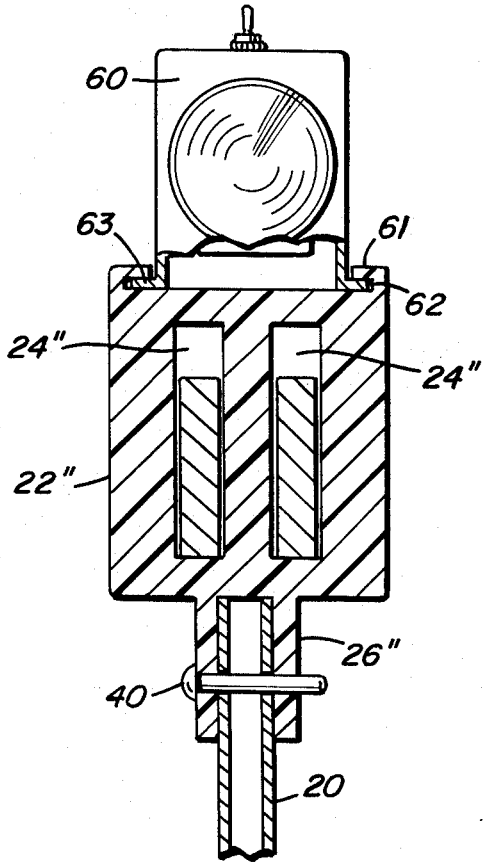
FIG. 17 is a sectional view taken generally along line 17—17 of FIG. 16.
Figure 18:
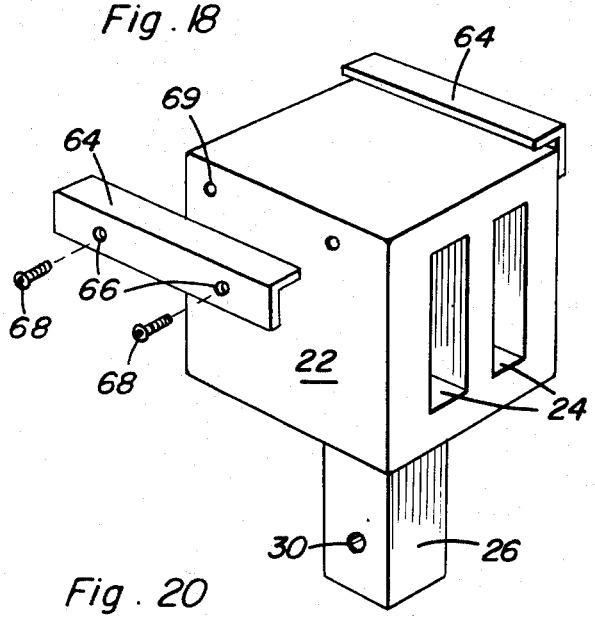
FIG. 18 is a perspective view of another modification of the head unit of FIG. 16.

Another feature of the disclosed barricade system is in the modification shown in FIGS. 16, 17 and 18. In this embodiment of the invention the double-slotted support head as shown in FIG. 3 is modified by providing flange support means at the top thereof for receiving an electrical flashing light device. Looking at FIGS. 16 and 17, the support head 22" having double slots therein 24" for holding the notched ends of cross tie members 32 is locked to support post 20 by means of pin 40 and post 26". The electrical flasher light device 60 is mounted at the top of the support head by means of the flange 61 and the recess formed thereby 62 at each side of the head. The bottom portion of the flasher light has an extending flange 63 which frictionally slides into the recesses 62 and is thereby frictionally retained therein. The support head 22" may be formed of molded plastic or similar material. In such case the flanges and recesses would be formed at the head of the device as it is molded. The member also could be made of wood and the recesses formed by a wood-working operation. Another way of modifying the concept shown in FIG. 3 is to use the support head 22 having the double slots 24 and modifying it as shown in FIG. 18 to achieve the desired results as of FIG. 16. This can easily be done by adding a flanged member 64 to each side of the upper part of the support head 22. The flanges 64 are provided with holes 66 for receiving the screws 68 which fasten the flanges to the head by means of holes 69 predrilled therein.

Figure 19:
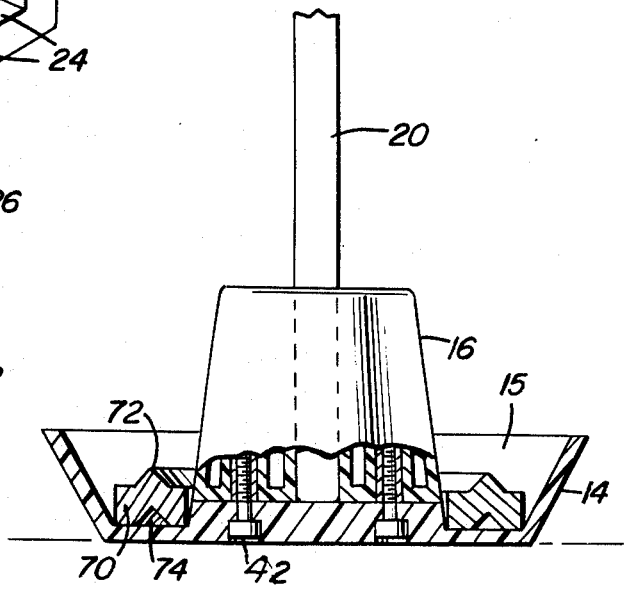
FIG. 19 is a partly sectional view of another embodiment of the base unit having a weight ring therein.
Figure 20:
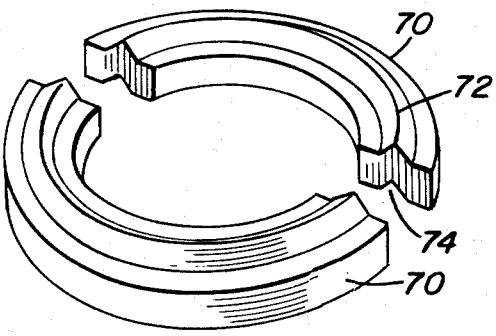
FIG. 20 is a perspective view of a weight ring.

FIG. 19 shows another adaptation of the base unit with cone mounted thereon for holding the support post 20. The recessed portion 15 of the base pan is designed to hold water, sand, dirt or rocks for added weight to prevent the support from tipping. Another component of the barricade system is a weight ring as shown in FIGS. 19 and 20. The recess 15 is the base pan and the weight ring are of approximately the same size so that the ring will easily fit inside the recess. The weight ring 70 as shown in FIG. 20, in perspective, is actually two identical half rings. Each half ring covers 180° in circumference and is formed with a recess 74 on one side thereof and a projection 72 on the opposite side. The rings are preferably made of heavy material, lead of course being one of the heaviest though also quite expensive. Concrete and materials of this nature are more likely substitutes. When the rings are being used to hold a base pan in place two rings are put into the recess 15 of the base pan so that their respective ends abut and then if more weight is desired another two half-rings are put in place over the first two with the joint openings being spaced 90° from the joint openings of the first pair and with the recess 74 of the upper rings fitting over the projections 72 of the lower rings. It can be seen that once so installed the added weight will not be easily displaced and will render the support practically untippable.

Figure 21A:
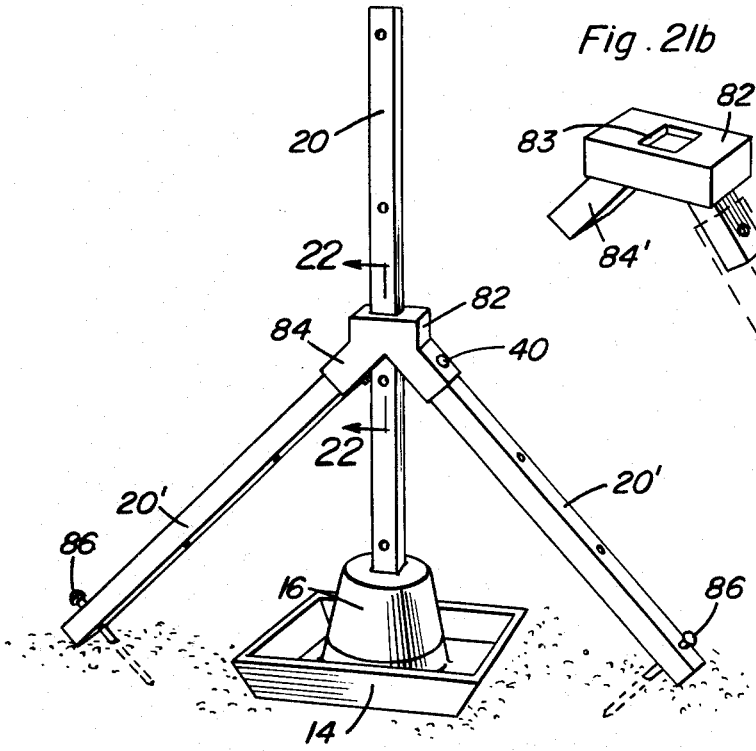
FIGS. 21*a* and 21*b* are perspective views of a brace sleeve assembly.
Figure 21B:
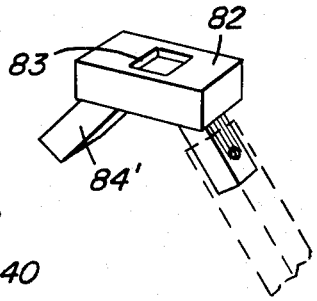
Figure 22:
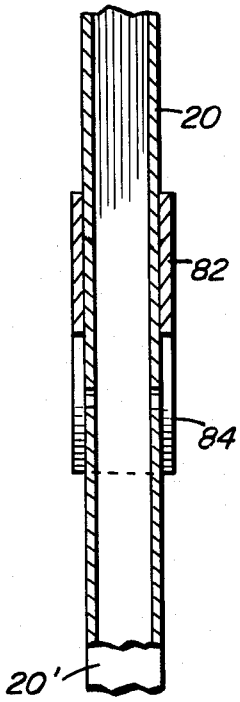
FIG. 22 is a part sectional view taken generally along line 22—22 of FIG. 21.

Another feature of the barricade system of this invention is the detachable hold-down brace sleeve assembly shown in FIGS. 21*a*, 21*b* and 22. This device consists of a sleeve member 82 having a hole 83 therein slightly larger than the support post 20 and of either rectangular or round shape to conform to the shape of the support post. Angle portions 84, 84' extending from said sleeve member are attached to the brace and hold-down members 20'. The members 84 in FIG. 21*a* are in the form of sockets for receiving the ends of support posts 20', and members 84' in FIG. 21*b* are in the form of pins for reception within the ends of support posts 20'. These are preferably at a 90° angle to each other to thereby form approximately a 45° angle with the support post when the brace is in place. Pins 86 are used to hold the brace assembly to the ground. Such brace assemblies would be necessary in areas of extremely high winds, such as in tornado or hurricane situations where it is important to warn of a bridge being out, etc. and also very important that the warning signs not be tipped over and/or destroyed.

Figure 23:
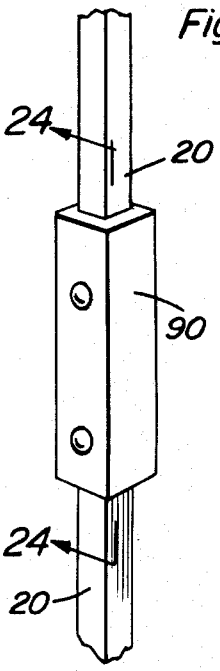
FIG. 23 shows in perspective another form of universal adapter.
Figure 24:
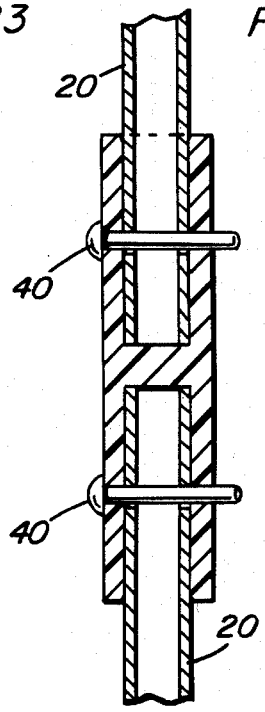
FIG. 24 shows in section the adapter taken generally along line 24—24 of FIG. 23.

A further embodiment of the barricade system is in the post extension adapter shown in FIGS. 23 and 24. This post extension adapter is used to attach two of the support posts 20 together in order to extend or increase their length. Said extender is shown as being square, however as mentioned above a round configuration may also be used. The adapter has holes therein spaced to correspond with the end holes of a standard support post 20 and the pins 40 as described before are insertable through the holes in the adapter and the support post 20 to be extended. FIG. 24, a cross-sectional vertical view best shows this.

Figure 25:
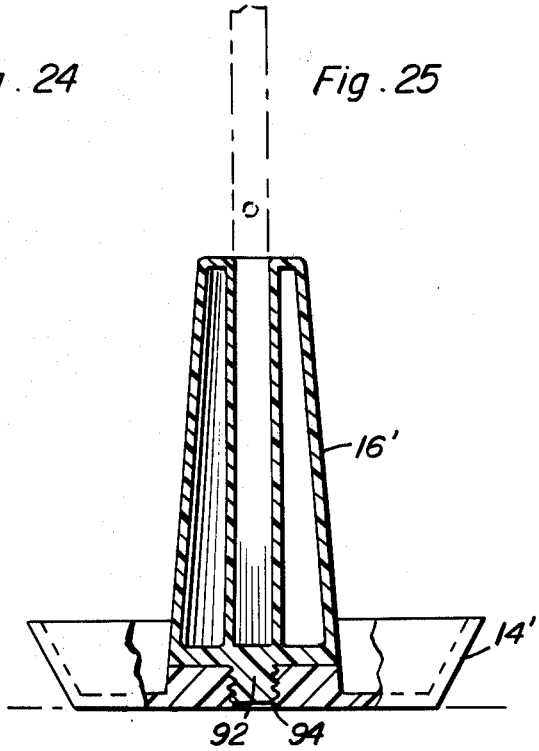
FIG. 25 shows another modification of the base unit and cone structure.
Figure 26:
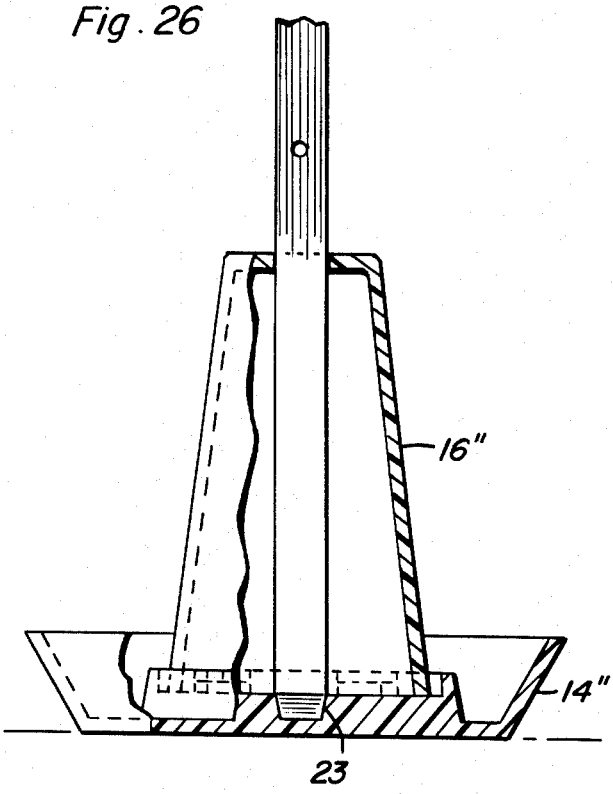
FIG. 26 shows, in cross section, a further modification of a base unit and cone structure.
Figure 27:
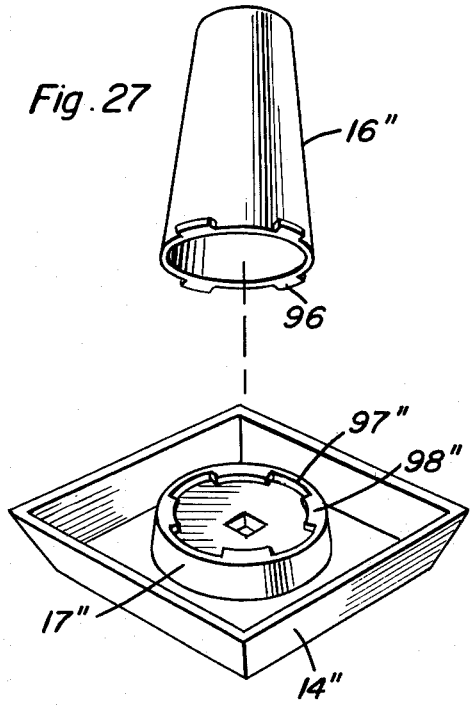
FIG. 27 shows, in perspective, the base unit and cone structure of FIG. 26.
Figure 28:
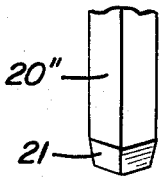
FIG. 28 shows in part, perspectively, the lower structure of a support member.
Figure 29:
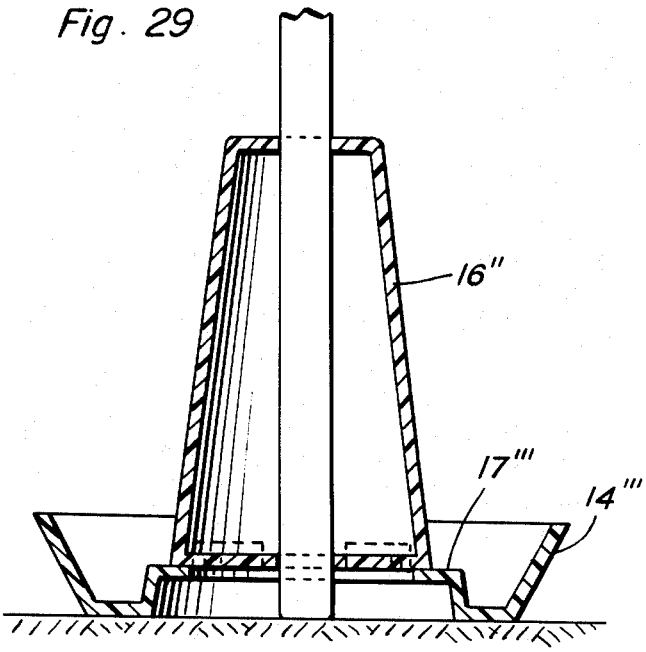
FIG. 29 shows in cross section another modification of the base unit and cone structure.
Figure 30:
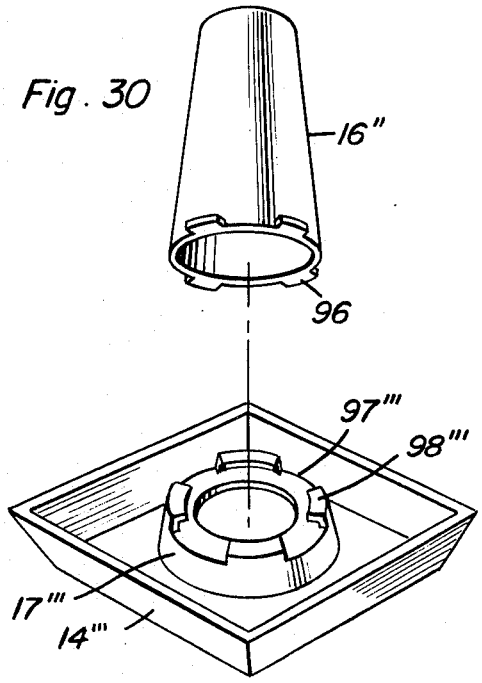
FIG. 30 shows in perspective the base unit and cone structure of FIG. 29.
Figure 34:
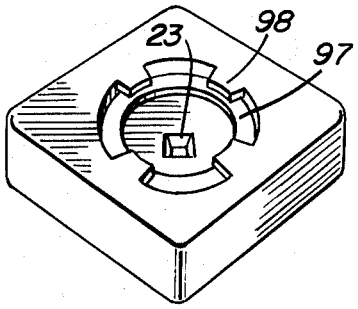
FIG. 34 is a further embodiment of the base unit.

FIG. 25 shows another modification of the base pan 14 and the cone unit 16. Herein the modified base pan is labeled 14' and the modified cone 16'. Instead of using threaded screws 42 to hold the two units together as shown in FIGS. 6 and 19, a projecting threaded stud 92 is shown on the lower portion of the cone 16' which screws into a threaded hole 94 in the base pan unit 14'. Still further modifications of components for the barricade system are shown in FIGS. 26 through 30. The cone unit in FIGS. 26, 27 is labeled 16" and it has projecting flanges 96 at the lower end thereof. These flanges are locked into the recesses 97" and overlying flanges 98" in the base unit 14" as best seen in FIG. 27. A quarter turn rotation of the cone unit with respect to the base unit will lock the two parts together. FIG. 28 shows the tapered lower portion 21 on a modified support post 20". The base member 14" has a similarly tapered recess 23 for receiving such modified support post. Obviously this modification could be applied to the cone/base unit combinations of the previously discussed figures. FIGS. 29 and 30 show a modification of the cone/base unit of FIGS. 26 and 27. Here the base unit 14''' has an internal center raised portion 17''' having thereon raised flanges 98''' which form spaced recesses 97''' therebetween. The over-all interlocking action is similar to that of the device in FIGS. 26 and 27. FIG. 34 shows a further embodiment of the base unit wherein the base unit instead of being of pan-like structure is of a flat type base construction. Interlocking flanges 98 are provided similar to those at 98" and 98''' of FIGS. 27 and 30. The advantage of this flat surfaced base unit is that it may be stacked for transportation more easily than the pan type base units. A similar tapered socket 23 is provided in this base unit like that shown in FIG. 26.

Figure 31:
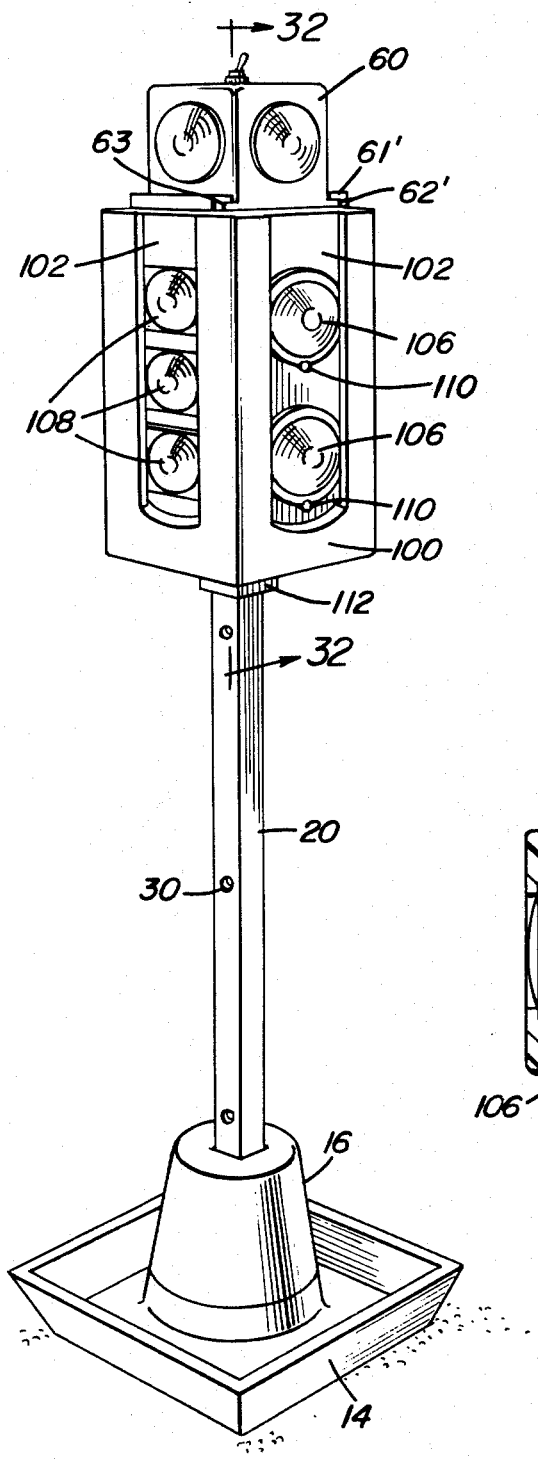
FIG. 31 shows the support structure of this invention as combined with warning signal indicator means.
Figure 32:
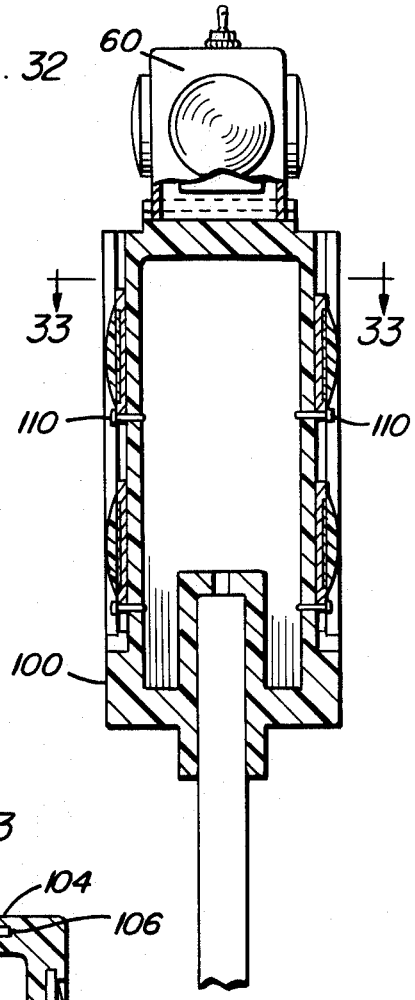
FIG. 32 shows the warning signal indicator means in cross section taken generally along line 32—32 of FIG. 31.
Figure 33:
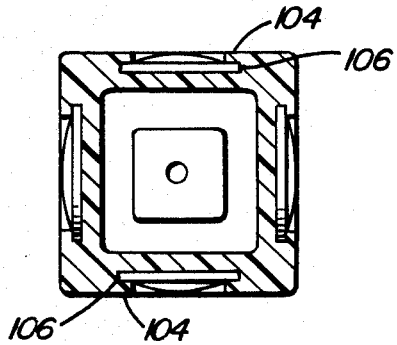
FIG. 33 is a top sectional view of the warning light structure taken generally along line 33—33 of FIG. 32.

A still further modification of component structure for the new and novel barricade system is disclosed in FIGS. 31, 32 and 33. Herein is shown on the base pan unit 14 with cone member 16 and support post 20 a warning light indicator structure 100. This structure has flanges 61' forming recess 62' therewith for receiving the lower flange portion 63 of an electrical flashing light device 60 as discussed previously. The structure 100 is square and rectangular as can be seen from the drawings. Each of the four vertical sides is provided with a slotted trough-like portion 102. The edges of these troughs 102 have flange portions 104 which form recesses 106 therewith. The purpose of these flanged recess portions is to receive either round or square reflector units 106, 108. Normal friction usually is adequate to retain the reflector units in spaced positions when the reflector head is mounted for use, but as shown in FIG. 31, retaining pins 110 may be added to support the respective reflectors. Again this device is shown as having a square socket portion 112 at the base thereof for receiving the square support post 20. However as mentioned previously round sockets and round support posts may be used.

As can be seen from the many figures of the drawings and many interrelated features of the component devices, over-all each of these devices cooperate in one way or another to form the novel barricade system of this invention. The various component devices are very useful in various combinations and offer the greater protection of properly constructed warning indicators not generally available in the field today.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A barricade system comprising: means for warning traffic of a dangerous situation and to protect them therefrom including; base means having at least two easily separable and connectible units, one unit being a base pan unit with a flat bottom portion and a center portion for connection to a second unit of cone shape, both units arranged for receiving removable support means, support means mounted thereon, head means on said support means for mounting barricade devices at an easily visible height, and the base pan unit has a raised outer edge forming a pan-like structure and a raised inner cylindrical portion for supporting the cone unit, the support means comprising a support tube unit, and the head means including a double-slotted body member having mounting means at the bottom thereof for engagement with the support tube, with the double-slotted body member having a mounting socket at the bottom thereof to provide the mounting means.

2. The device of claim 1 wherein the head body includes a flanged section at the top thereof for mounting a flashing light type warning device.

3. The device of claim 2 including weight means added to the recessed pan base unit.

4. The device of claim 1 wherein interlocking flanges are provided between the base pan unit and the cone unit for positive interlocking of said two units together.

5. The device of claim 1 wherein the support tube unit has a tapered lower portion and the base pan unit has a socket correspondingly tapered.

6. A barricade system comprising: means for warning traffic of a dangerous situation and to protect them therefrom including; base means having at least two easily separable and connectible units, one unit being a base pan unit with a flat bottom portion and a center portion for connection to a second unit of cone shape, both units arranged for receiving removable support means, support means mounted thereon, head means on said support means for mounting barricade devices at an easily visible height, and the base pan unit having a raised outer edge forming a pan-like recessed portion and a raised inner cylindrical portion for supporting the cone unit, the mounting means for the double-slotted body member comprising a mounting pin, the support tube being a square tube, and the cone unit and base unit having square holes therein for receiving the support post tube, the head body including a flanged section at the top thereof for mounting a flashing light type warning device, weight means added to the recessed pan base unit, the weight means comprising two semi-circular weights having a recessed groove along one side thereof and flanged projection along the opposite side thereof, for interlocking said weights when stacked in the pan base unit.

7. A barricade system having numerous interchangeable units including a base pan unit, a cone-type unit removably attached to said base pan unit, a support tube unit, a support head unit having double slots therein, said support tube unit mountable on the cone-type unit when attached to the base pan unit for supporting thereon said support head unit, a cross-tie unit for support between adjacent support head units, and at least one universal adapter unit for mounting warning signs on such a cross-tie unit, the base pan unit having a flat base portion raised outer edge therearound, and a raised cylindrical center portion with holes therein and a cone-type unit mounted interchangeably on the raised cylindrical portion of the pan unit, with the cross-tie unit having ends with notches at the bottom thereof for lockably retaining the cross-tie unit in the support head units.

8. The device of claim 7 wherein the support head is closed at the top of said head.

9. The device of claim 8 wherein the support head double slots are open at the upper side thereof for directly receiving cross-ties from above the support head unit.

10. The device of claim 8 wherein a universal adapter is included for attaching appropriate warning signs to a cross-tie unit, said universal adapter having a fixed slot at one end thereof of appropriate size for fitting a cross-tie unit and a thinner slot at the other end thereof for engaging a thin sign.

11. The device of claim 10 wherein all of the component units have their engaging portions of square shape.

12. The device of claim 10 wherein all of the units have their engaging portions of round shape.

13. The device of claim 9 wherein the support head has an outside socket type mounting at the bottom thereof.

14. The device of claim 8 wherein the support head has a pin type mounting at the bottom thereof.

15. A barricade warning device comprising at least one base unit, a separate cone unit removably attached to the base unit, support means mounted on these units including a support post, and warning means mounted on the support means, and a support post extension bracket which is substantially rectangular in shape and having sockets from each end thereof and holes therethrough for receiving retaining pins, said pins being of resilient flexible material.

16. The device of claim 15 wherein the warning means includes a support head having provisions for mounting a flashing signal light at the top thereof.

17. The device of claim 16 wherein said mounting provisions consist of a recess having outer flanged members for engaging a complementary flanged portion at the bottom of the flashing signal light means.

18. The device of claim 16 wherein said mounting provisions comprise a flat portion at the top of the support head and including removable angle iron type brackets which are fastened to the top of said head at two edges thereof to thereby form a recess with flanged edges for engaging a complementary flanged portion at the bottom of the flashing signal light means.

19. The device of claim 15 wherein the support means includes an additional attachable hold down brace sleeve assembly unit for the support post.

20. The device of claim 19 wherein the brace sleeve assembly comprises a center body portion having a socket therein for slipping over the support post, angle members coming off the bottom of said member and attached to leg portions at approximately 45° to the vertical, said leg portions being provided with holes and with pins through said holes for ground engagement.

21. A barricade warning device comprising at least one base unit, a separate cone unit removably attached to the base unit, support means mounted on these units including a support post, and warning means mounted on the support means, the base unit having a socket with threads therein for receiving the removable cone unit having a bottom screw-threaded stud projecting therefrom.

* * * * *